US006652436B1

(12) United States Patent
Yeager et al.

(10) Patent No.: US 6,652,436 B1
(45) Date of Patent: Nov. 25, 2003

(54) METHOD OF MAKING TAMPER-EVIDENT PACKAGE WITH SLIDER ZIPPER

(75) Inventors: James W. Yeager, Mobile, AL (US); John F. Hogan, Alpharetta, GA (US)

(73) Assignee: Innoflex Incorporated, Mobile, AL (US)

( * ) Notice: Subject to any disclaimer, the term of this patent is extended or adjusted under 35 U.S.C. 154(b) by 177 days.

(21) Appl. No.: 09/706,362

(22) Filed: Nov. 3, 2000

(51) Int. Cl.[7] ..... B31B 1/84
(52) U.S. Cl. ..... 493/213; 493/927; 493/394
(58) Field of Search ..... 493/394, 213, 493/308, 927; 53/133.4, 139.2

(56) References Cited

U.S. PATENT DOCUMENTS

| | | | | |
|---|---|---|---|---|
| 4,241,865 A | | 12/1980 | Ferrell | |
| 4,335,817 A | | 6/1982 | Bahr | |
| 4,909,017 A | * | 3/1990 | McMahon et al. | 493/213 |
| 5,007,143 A | | 4/1991 | Herrington | |
| 5,010,627 A | | 4/1991 | Herrington et al. | |
| 5,063,644 A | | 11/1991 | Herrington et al. | |
| 5,067,208 A | | 11/1991 | Herrington, Jr. et al. | |
| 5,070,583 A | | 12/1991 | Herrington | |
| 5,152,613 A | | 10/1992 | Herrington, Jr. | |
| 5,161,286 A | | 11/1992 | Herrington, Jr. et al. | |
| 5,167,608 A | | 12/1992 | Steffens, Jr. et al. | |
| 5,442,838 A | | 8/1995 | Richardson et al. | |
| 5,782,733 A | | 7/1998 | Yeager | |
| 5,816,018 A | * | 10/1998 | Bois | 53/133.4 |
| 5,871,281 A | | 2/1999 | Stolmeier et al. | |
| 6,003,582 A | | 12/1999 | Blohowiak et al. | |
| 6,014,795 A | | 1/2000 | McMahon et al. | |
| 6,047,450 A | | 4/2000 | Machacek et al. | |

FOREIGN PATENT DOCUMENTS

| | | |
|---|---|---|
| CH | 424 108 | 5/1967 |
| CH | 675 235 | 9/1990 |
| EP | 485 741 | 10/1991 |
| WO | WO 00/64765 | 11/2000 |

* cited by examiner

*Primary Examiner*—Eugene Kim
*Assistant Examiner*—Sameh Tawfik
(74) *Attorney, Agent, or Firm*—Wood, Phillips, Katz, Clark & Mortimer

(57) ABSTRACT

A method of making a recloseable package having a slider zipper assembly includes advancing a web of a plastic film material in a direction along a longitudinal axis thereof, and applying a plurality of profile strip fastener assemblies to the plastic film material transversely of the longitudinal axis. A slider is applied to each of the fastener assemblies so that movement of each slider along the length of the respective one of the fastener assemblies moves the pair of profile strips thereof into and out of interlocking engagement. Opposite side edges of the plastic film material are joined to form a tube, with seals formed transversely of the tube to form a top seal and a bottom seal for each of the packages. The package is configured such that the slider projects generally through the front wall of the package, with the front wall optionally being provided with a frangible region in the form of a line of weakness aligned with the fastener assembly. Initial opening movement of the slider acts to fracture the frangible region for tamper-evidence.

7 Claims, 5 Drawing Sheets

METHOD OF MAKING TAMPER-EVIDENT PACKAGE WITH SLIDER ZIPPER

BACKGROUND OF THE INVENTION

Slider zippers are becoming very popular with consumers for use with reclosable consumer storage bags, such as freezer and sandwich bags. This popularity is the result of the relatively greater ease of opening and closing slider zippers, especially for the increasing population of older consumers that tend to have more trouble manipulating the typical press-to-lock zipper closures that are commonly found on storage bags.

The use of slider zippers has recently expanded to include bags that are sold containing retail items, such as food products, where it enjoys the same easy opening zipper advantage. Although the typical slider zipper is substantially more expensive, it can be particularly advantageous for use with packages that are sold containing retail items. When selling a bag containing a stored product, the total cost of the package including the stored product is much higher, and as a result it is easier to pass on the incremental cost of the slider zipper.

Other than the higher zipper cost, the most significant hindrance to the promotion of zippered packages with sliders has resulted from manufacturing difficulties that must be considered when attempting to make slider bags formed around a product, especially when using a vertical form, fill, and seal process for making such bags. Slider bags traditionally have been made adjacent to one of the package end seals. In the traditional arrangement, the slider element is secured to the outside of the package by connecting it over one side of the closure strips. In a typical form, fill process of making bags the adjacent bags remain connected at their ends, that is, the top of one bag is connected to the bottom of the next bag. This interconnection of bag ends makes it difficult to connect a slider over closure strips in the traditional manner when forming bags utilizing a typical form, fill, and seal process.

The present invention teaches a method of making a reclosable package that utilizes a zipper assembly that includes a slider element for ease of opening. and that overcomes the obstacles presented by the typical form, fill and seal process of making bags.

SUMMARY OF THE INVENTION

In accordance with the present invention, a method of making recloseable packages each having a slider zipper assembly is disclosed, with the method promoting efficient, high-speed manufacture and use of such packages in connection with a typical form, fill, and seal packaging process. Packages formed in accordance with the present invention offer the convenience of use of a fastener assembly having a slider element, and can be configured to provide a tamper-evident feature which functions in conjunction with movement of the fastener slider.

A method of making recloseable bags, each having a slider zipper assembly, in accordance with the present invention, comprises the steps of advancing a web of plastic film packaging material in a direction along a longitudinal axis thereof. The present method further includes applying a plurality of profile strip fastener assemblies to the plastic film material transversely of the longitudinal axis thereof. Each of the fastener assemblies comprises a pair of interlocking profile strips, with the fastener assemblies being spaced apart by a distance corresponding to the length of each of the recloseable packages being formed. Preferably, each of the profile strips includes a body portion, and a flange portion joined thereto. The body portions of the fastener assembly respectively include at least one cooperating, interlocking protuberance and groove arrangement for releaseably interconnecting the profile strips. Preferably, the flange portions of the profile strips extend in opposite directions from the respective body portions, thus facilitating efficient formation of the present package, including the necessary application of a slider to each fastener assembly.

The present method further includes the step of applying a slider to each of the fastener assemblies, so that movement of each slider along the length of the respective one of the fastener assemblies moves the pair of profile strips thereof into and out of interlocking engagement. The present process is completed by joining opposite side edges of the plastic film material to form a tube, and forming seals transversely of the tube to form a top seal and bottom seal for each of the packages.

One aspect of the present method which promotes efficiency is the manner in which the sliders are secured to the fastener assemblies during package formation. When package formation is effected in conjunction with use of a form, fill, and seal machine, the present method contemplates that the plastic film material is guided over a forming collar to shape the material into a generally tubular configuration prior to the step of joining opposite side edges of the material. In order to assure efficient movement of the plastic film material over the forming collar, it is preferred that the step of applying the slider assembly be performed after the step of guiding the plastic material over the forming collar. In the illustrated embodiment, the step of applying the slider is performed after the step of joining opposite side edges of the plastic film, but it will be understood that the slider could be applied before the side edges of the film are joined, but preferably after the film has been guided over the forming collar and shaped to a generally tubular configuration.

It is contemplated that the fastener assemblies are applied to a surface of the plastic film which becomes an inside surface of the tube, and that each slider is applied to the respective fastener assembly from a side of the plastic film opposite that surface. When configured in this fashion, it is contemplated that a frangible, tamper-evident region can be formed in the plastic film material for respective alignment with each fastener assembly. By this configuration, initial opening movement of the slider fractures the frangible region for tamper-evidence.

Each slider is configured to facilitate application to its respective fastener assembly without separation of the profile strips thereof. Each slider includes a pair of tapered walls for respective, interlocking sliding connection with the pair of profile strips of each fastener assembly. The profile strips are configured such that they are moved into and out of locking engagement with each other in directions generally parallel to a longitudinal axis of the package. This is in distinction from profile strips oriented such that the strips must be moved inwardly and outwardly with respect to each other for effecting engagement and disengagement.

A recloseable package having a slider zipper assembly configured in accordance with the present invention includes a rectangular plastic film web having side edges joined to each other to form a back seam, to thereby form a front wall and back wall of the package. The front and back walls are joined to each other at transversely extending seams at the top and bottom of the package.

A fastener assembly comprising a pair of interlocking profile strips is joined to the front wall of the package in spaced relationship to the end seam at the top of the package. A slider is applied to the fastener assembly so that movement of the slider along the length of the fastener assembly moves the profile strip into and out of interlocking engagement with each other in directions generally parallel to a longitudinal axis of the package. The fastener assembly is preferably joined to the inside surface of the front wall, with the front wall defining an opening in alignment with the slider for facilitating manipulation thereof.

To provide a tamper-evident feature, the front wall of the package can include a frangible, tamper-evident region in alignment with the fastener assembly, so that initial opening movement of the slider fractures the frangible region. The frangible region is selected from the group consisting of laser scoring, mechanical scoring, and perforations. Manufacture of the present package is facilitated by providing each of the profile strips of the fastener assembly with a body portion, and a flange portion having a width greater than the width of the respective body portion, with the fastener assembly being joined to the front wall by joining of the flange portion of each of the profile strips to the front wall. The flange portions of the profile strips preferably extend in opposite directions from the respective body portions.

Other features and advantages of the present invention will become readily apparent from the following detailed description, the accompanying drawings, and the appended claims.

DETAILED DESCRIPTION

Figure 1:
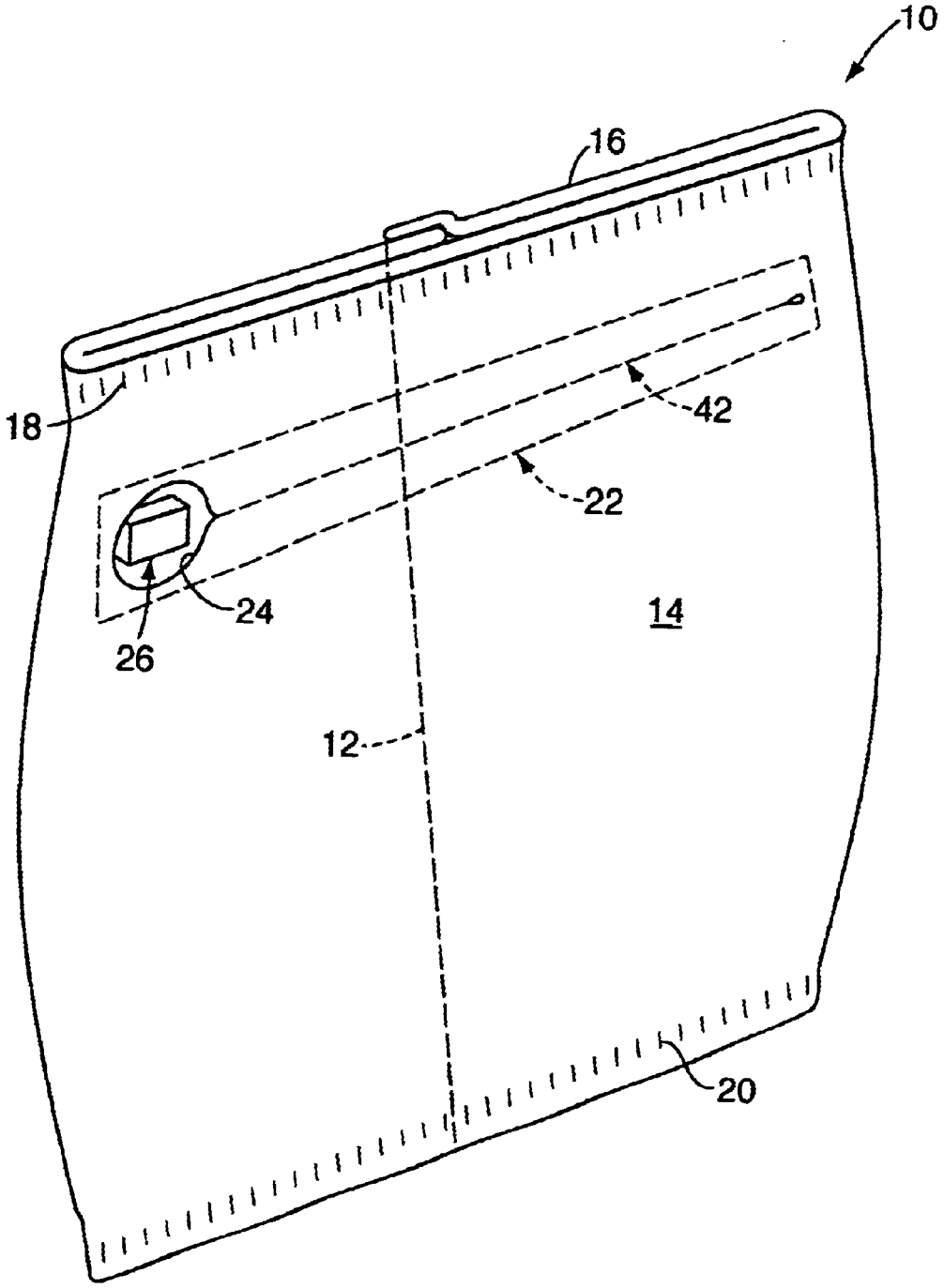
FIG. 1 is a perspective view of a recloseable package having a slider zipper assembly configured in accordance with the present invention.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

According to the present invention, zipper assemblies formed from male and female interlocking profile strips can be pre-applied to a web of packaging material prior to being formed into a bag when using a form, fill and seal process. Preferably the orientation of each zipper assembly is perpendicular to the longitudinal forming axis of the process of forming bags from the web. U.S. Pat. No. 5,782,733 shows such an arrangement and is hereby incorporated by reference.

Each profile strip of the present invention is provided with a slider groove on one side of each strip, that is away from the side having the male and female interlocking closure elements. These slider grooves match ribs located in the slider so that they interlock with one another. The clearance between the slider ribs and slider grooves are such that the slider can slide axially down the length of the closure strips while maintaining contact with each other. The present invention recognizes that the grooves could be placed in the slider instead of in the profile strips, with the matching ribs be located in the closure strips as opposed to the slider. In either case, the slider is tapered so that the ribs are farther apart at one end of the slider than at the other end, whereby the profile strips are either forced apart or together depending on the direction of movement of the slider along the closure strip.

When connecting the slider to the profile strips by the use of a rib and groove arrangement, it avoids the need to use a slider containing a separator finger. As taught by the prior art, typical slider assemblies utilize a separator finger, which is placed between the closure strips and functions to separate the profile strips by forcing them apart during opening. Such sliders using fingers in combination with interlocking closure strips are well-known in the art. Prior art teaching sliders utilizing separator fingers are shown in U.S. Pat. No. 5,010,627 and No. 5,871,281.

An advantage to using the rib and groove design of the present invention is that it can be applied to the profile strip without having to separate the closure strips, as required when using a slider with a finger. When profile strips are applied perpendicularly to the web forming direction it is much more difficult to separate the strips during the zipper application process as when applying zippers longitudinally to the web direction. Therefore, having a slider that can be easily applied to the profile strips without the need to separate the strips is an important improvement over the prior art.

Although slider zippers not utilizing separator fingers have been developed for use with reclosable packaging, it is believed that they are less desirable for use with front panel transversely positioned zipper arrangements than the slider zipper arrangement disclosed by the present invention. These slider zippers without separator means are well-known in the art as rolling action slider zippers. Typical rolling action slider zippers utilize sliders that roll the closure strips in such a way that causes the interlocking elements to roll into either locked or unlocked relationship depending upon the direction the slider is moved. It is recognized that rolling action slider zippers, such as taught by U.S. Pat. No. 5,442,838 and No. 6,014,795, could be used with the teachings of the present invention and therefore, U.S. Pat. No. 5,442,838 and No. 6,014,795 are hereby incorporated by reference.

When forming bags on a typical form, fill, and seal machine, especially a conventional vertical form, fill, and seal machine, a typical slider is too large to pass through the tight space between the forming collar and filling tube. The present invention recognizes that the slider should be applied to the fastener assembly closure after the web has been pulled through the tight space between the tube and collar. Therefore, by utilizing the rib and groove design of the present invention, or another suitable slider without a separator finger, the slider can be applied after the web of packaging material containing the pre-applied fastener strips has been fed into a typical form, fill, and seal machine.

Once the web with the closure strip is applied, and it has passed between the forming collar and forming tube, the ribs of the slider are snapped into the grooves of the profile closure strips. Since the closure assemblies are applied onto the side of the forming web that results in the inside surface of a resultant bag, an opening is provided in the portion of the web that forms the front panel of each bag. This opening is provided in the front panel so that the slider can pass through the web and be brought into direct contact with the profile strips that form the assembly. The hole is preferably placed through the web during the process of pre-applying the zippers, but each hole could be later placed in the web at the form, fill, and seal machine prior to the placement of the slider.

To create a reclosable bag using a slider zipper with a tamper-evident feature, so that it is easy to identify when a bag's closure has been opened, a frangible region in the form of a line of weakness is formed in the package, adjacent the zipper and aligned with the slider passage opening. The line of weakness acts to allow the movement of the slider to easily penetrate the front panel of the package adjacent the zipper. The line of weakness can be formed using a variety of techniques well-known in the art, such as, laser scoring, mechanical scoring, and the use of perforations.

With reference first to FIGS. 1 through 5, therein is illustrated a recloseable package 10 having a slider zipper assembly embodying the principles of the present invention. As will be further described, recloseable package 10 can be efficiently formed in accordance with the method of the present invention, whereby the recloseable package can be formed in conjunction with operation of an associated form, fill, and seal machine, with packages thus formed attendant to disposition of the contents of each package therein. Formation in this manner greatly facilitates efficient and economical use of the present package.

The package 10 is formed from a rectangular plastic film web, which during package formation is cut from a web of plastic film packaging material. The side edges of the plastic film web are joined to each other to form a back seam 12, with the package 10 thus having a front wall 16 and a back wall 18. The front wall 16 and back wall 18 are joined to each other by transversely extending end seals, including top seal 20 and bottom seal 22.

A fastener assembly, generally designated 22, is applied to the front wall 14 of the package 10 in spaced relation to the end seam 18 at the top of the package. Fastener assembly 22 is preferably provided on the inside surface of the plastic film web of the package, and accordingly, the front wall 14 of the package defines an opening 24, for disposition of a slider 26 on the fastener assembly 22.

Figure 2:
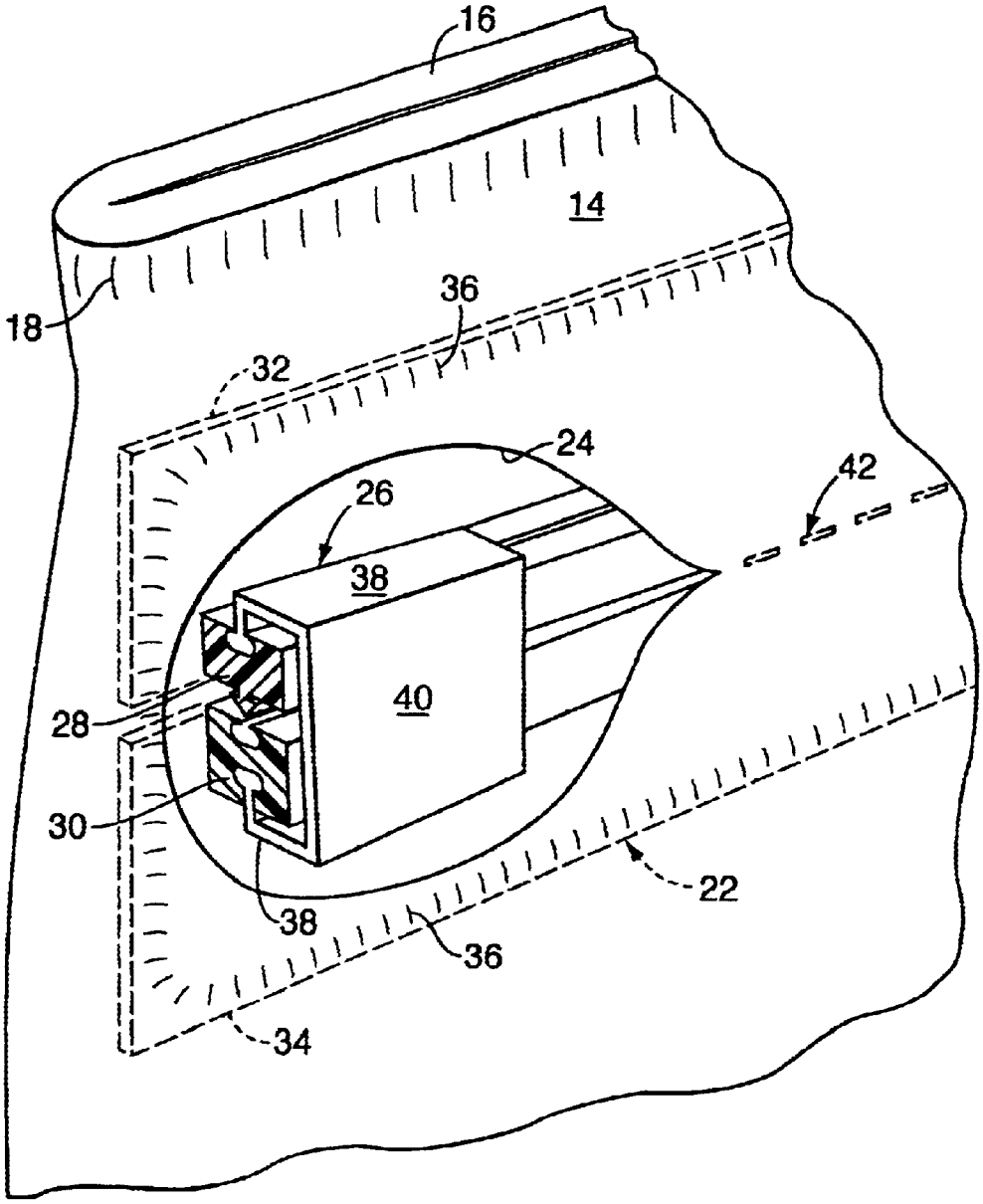
FIG. 2 is an enlarged, fragmentary view of the package shown in FIG. 3, partially cut-away, to illustrate the slider zipper assembly of the package.
Figure 3:
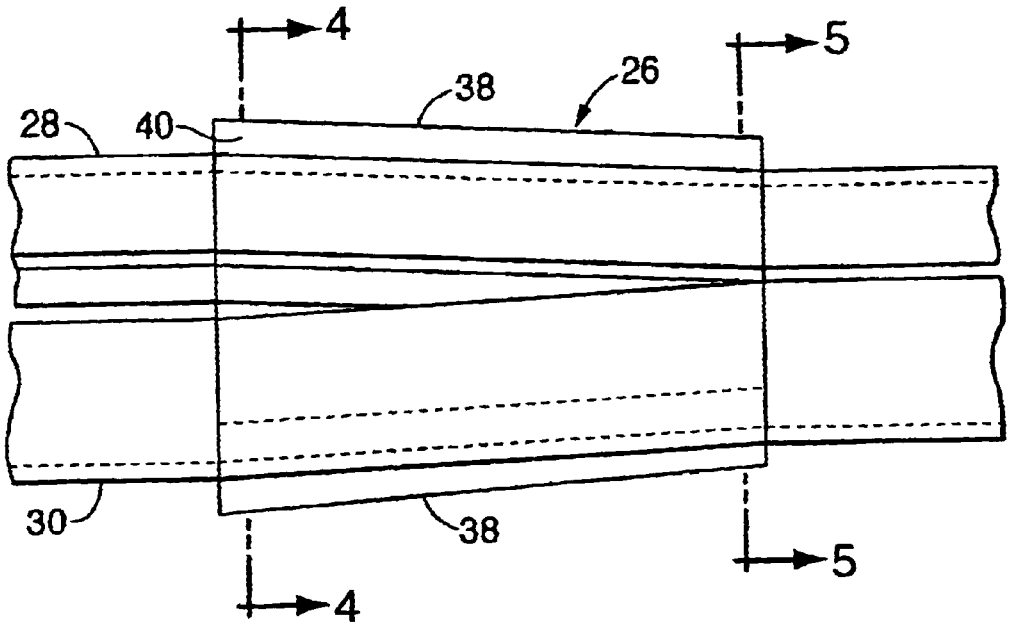
FIG. 3 is a diagrammatic view further illustrating the slider zipper assembly used for practicing the present invention.

With particular reference to FIG. 2, the fastener assembly 22 includes a pair of cooperating, interlocking profile strips which can be moved into and out of interlocking relationship with each other. To this end, the profile strips include cooperating body portions 28, 30, with each of the profile strips in turn including a respective flange portion 32, 34 joined to the body portion. Each of the flange portions has a width greater than the width of the respective body portion to facilitate securement of the fastener assembly to the plastic film web of the package such as by heat-sealing. As illustrated, the flange portions 32, 34 extend in opposite directions from the body portions 28, 30, with the body portions thus positioned adjacent each other for interlocking cooperation. In this regard, it is preferred that the body portions of the profile strips, which respectively define one or more cooperating grooves and protuberances, are configured such that the body portions move in and out of interlocking relationship in directions generally parallel to the longitudinal axis of the package (i.e., generally upwardly and downwardly, referring to the orientation of FIG. 2). This is in distinction from profile strip fasteners configured to move in and out of interlocking relationship in directions generally inwardly and outwardly of the package. The illustrated arrangement facilitates application of slider 26 to the profile strips, and subsequent movement of the profile strips into and out of interlocking relationship by sliding movement of the slider 26 along the length of the profile strips. As illustrated, one or more heat seals, generally designated 36, join the flange portions 32, 34 of the profile strips to the front wall 14 of the package 10.

The slider 26 includes a pair of tapered walls 38 for respective interlocking, sliding connection with the body portions 28, 30 of the profile strips of the fastener assembly 22. The tapered walls 38 are integrally joined to each other by an interconnecting wall 40, such that the slider 26 has a generally C-shaped configuration, when viewed in cross-section. (See FIGS. 4 and 5.) Notably, the preferred configuration of slider 26 does not include a so-called separator finger, for disposition between the body portions 28, 30 of the profile strips of the fastener assembly. Thus, during application of the slider 26 to the profile strips, the profile strips need not be separated for operatively interconnecting the slider therewith. This permits application of the slider to the profile strips after the fastener assembly has been joined to the plastic film web from which the package 10 is being formed.

Figure 4:
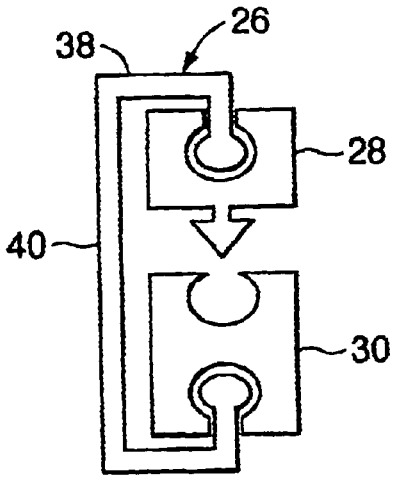
FIG. 4 is a view taken along lines 4—4 of FIG. 3.
Figure 5:
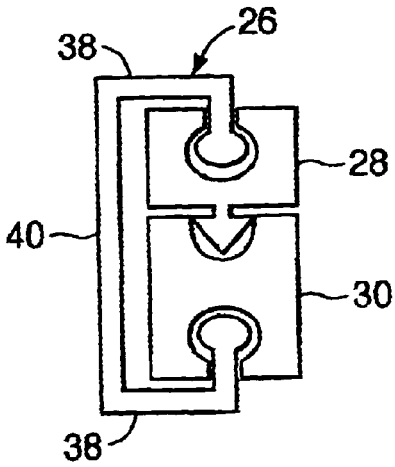
FIG. 5 is a view taken along lines 5—5 of FIG. 3.

As further illustrated, the slider 26 includes upper and lower interlocking elements for respective interlocking, sliding cooperation with the body portions 28 and 30 of the profile strips of the fastener assembly 22. The slider is configured such that after application to the body portions of the profile strip, movement of the slider 26 along the length of the profile strips acts to move the body portions 28, 30 into, and out of, interlocking relation with each other. This action is illustrated in FIGS. 4 and 5, wherein the cooperating protuberance and groove of the body portions of the profile strips are shown in and out of engagement with each other.

As illustrated in FIGS. 1 and 2, the present package 10 include a tamper-evident feature which is operated in conjunction with use of the slider 26 on the fastener assembly. In particular, the front wall 14 of package 10 defines a frangible portion provided in the form of a line of weakness 42 aligned with the fastener assembly 22, preferably extending generally from opening 24 in the front wall 14 of the package 10. The line of weakness 42 can be selected from the group consisting of laser scoring, mechanical scoring, or perforations (such as shown), with the line of weakness fracturing attendant to initial opening movement of slider 26 as it is moved relative to the fastener assembly 22 to initially separate and open the profile strips of the fastener assembly.

In the illustrated embodiment, the profile strips of the fastener assembly 22 are shown as each including a respective flange portion, 32, 34. It is within the purview of the present invention that these flange portions may be provided as a unitary element, having a line of weakness or the like so that the flange portions separate attendant to operation of the slider 26 and separation of the respective body portions 28, 30 of the profile strips. It is also within the purview of the present invention that a peal seal or the like can be provided between the flange portions of the profile strips for separation attendant to initial opening movement of slider 26 for moving the body portions 28, 30 of the profile strips out of interlocking engagement with each other.

As will be appreciated, it is desirable that the slider 26 be maintained in position on the profile strips of the fastener assembly, and not inadvertently slide off the ends of the profile strips. To this end, it can be desirable to seal the ends of the profile strips to each other, such as heat sealing the body portions 28, 30 to each other generally at the ends of the fastener assembly. Additionally, the disposition of the fastener assembly on the inside surface of the front wall 14 of the package 10, with the slider 26 generally projecting through the front wall, can act to limit sliding movement of the slider 26 as the slider engages the ends of the opening formed in the front wall by opening 24 and line of weakness 22.

Figure 6:
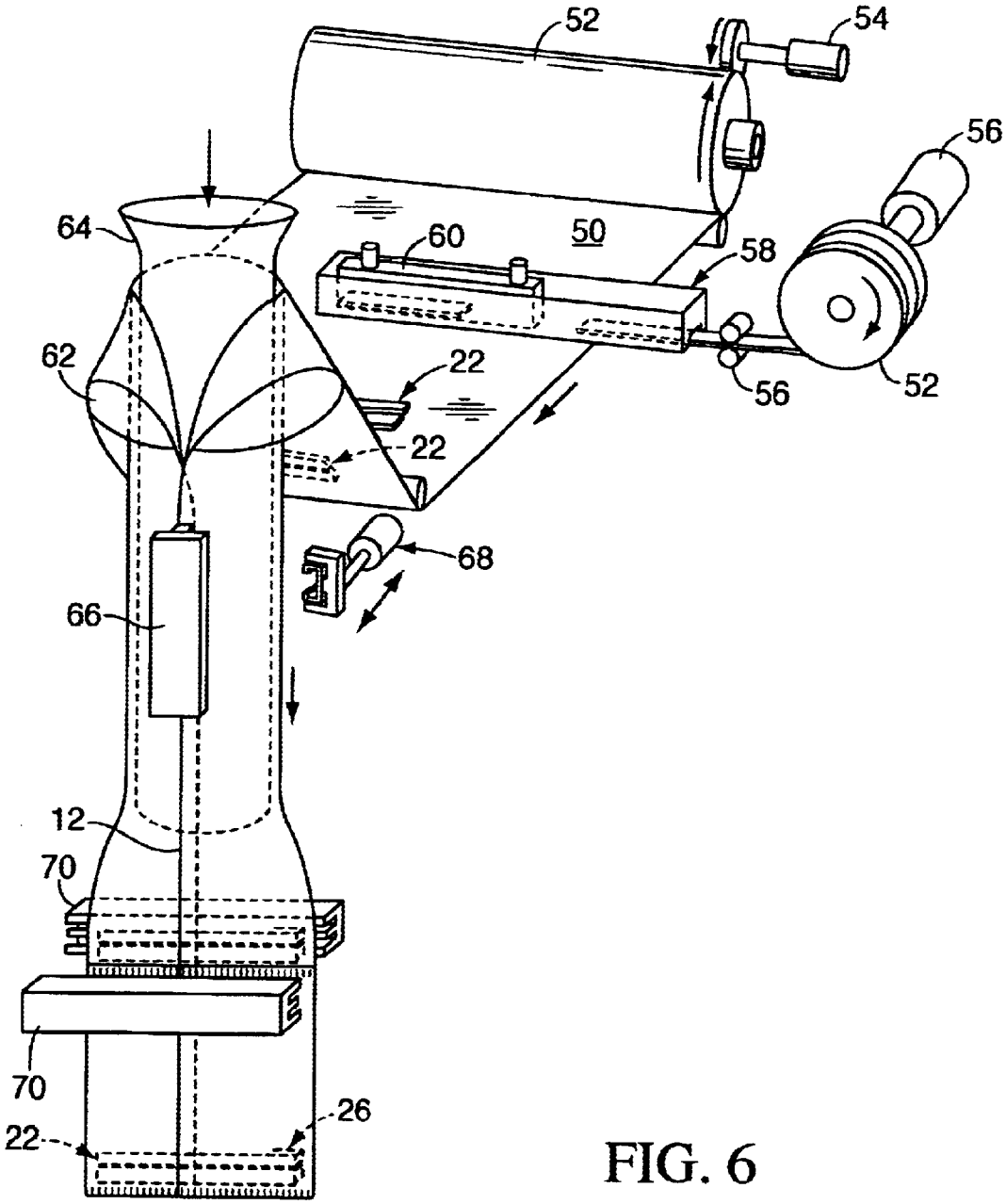
FIG. 6 is a perspective, diagrammatic view of an apparatus for practicing the present method of making recloseable packages with slider zipper assemblies, illustrated in conjunction with a form, fill, and seal filling process.
Figure 7:
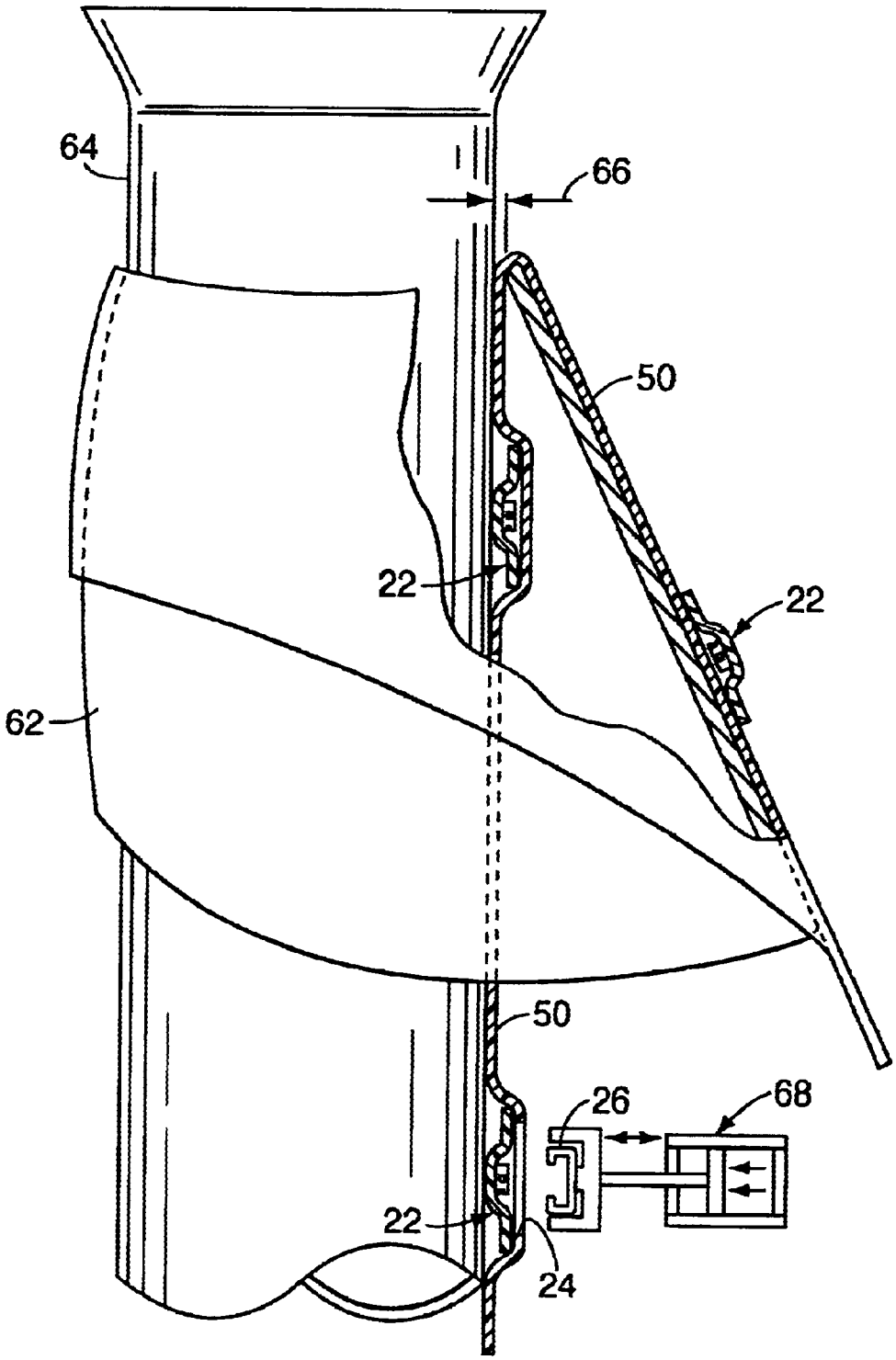
FIG. 7 is a side elevational view of the apparatus illustrated in FIG. 1, further illustrating formation of recloseable packages in accordance with the present invention.

With particular reference to FIGS. 6 and 7, therein is diagrammatically illustrated an apparatus for making recloseable bags having slider zipper assemblies embodying the principles of the present invention. Summarizing, a recloseable package 10 is formed in conjunction with operation of an associated form, fill, and seal machine, whereby packages are formed in end-to-end relationship as the packages are filled. Formation in this manner promotes efficient use of the package. As will be further described, the packages are generally formed such that the fastener assemblies are applied to a web of plastic film material, and the web of plastic film material shaped to a generally tubular configuration. A slider is then applied to each of the fastener assemblies, with filling of each package, and completion of its formation, preferably thereafter effected.

As illustrated in FIG. 6, a web of plastic film material 50 is unwound from a roll 52 by a suitable unwinding drive 54. After the web of material 50 is unwound, a plurality of fastener assemblies 22 are applied and joined to the web of material, such as by heat-sealing, with the fastener assemblies being spaced apart by a distance corresponding to the length of each of the recloseable packages being formed.

The fastener assemblies 22 are applied to the plastic film material transversely of the longitudinal axis thereof, preferably by movement of the fastener assemblies in a direction transversely of the direction of movement of the plastic film material. Application mechanisms as are known in the art can be employed for applying the fastener assemblies 22, such as by heat-sealing of flange portions of the fastener assemblies to the surface of the plastic film web which will become the inside surface of the package being formed. The fastener materials can be provided from a roll 54 driven by a suitable unwind drive 56, with individual fasteners formed by cutter mechanism 58. Each fastener assembly is preferably applied with the profile strips thereof in interlocking relationship with each other. As discussed above, it is within the purview of the present invention that ends of the profile strips be sealed to each other, and such sealing can be effected attendant to placement of the individual fastener assemblies on the plastic film web. An application mechanism 58, which can include a suitable heat-sealing bar 60, can be employed for applying each of the fastener assemblies 22 to the plastic film material. A suitable application mechanism is disclosed in U.S. Pat. No. 6,003,582, hereby incorporated by reference.

As noted, formation of the present recloseable package is preferably effected in conjunction with operation of an associated form, fill, and seal machine. As will be recognized by those familiar with the art, this type of machine typically includes a forming collar 62 for shaping a plastic film web into a generally tubular configuration about an associated filling tube 64 through which the contents of each package are directed for disposition in each package as the packages are formed generally about the filling tube.

As will be recognized, this type of packaging equipment requires movement of the plastic film web along a relatively tightly controlled path to assure efficient and smooth formation of a tube for subsequent package formation. In particular, as illustrated in FIG. 7, the web material 50 must move over forming collar 62 through a tightly controlled clearance, indicated at 66, with the web being generally inverted as it is shaped into a generally tubular configuration.

Accordingly, it is presently preferred in the present method that the slider 26 of each recloseable package be applied to its respective fastener assembly 22 after the plastic film material has been shaped to a generally tubular configuration, that is, after the plastic film material has been guided over the forming collar 62 of the filling apparatus. The plastic film material is shaped to the generally tubular configuration prior to the step of joining opposite side edges of the film material, and it is presently preferred that the slider be applied to the respective fastener assembly after the step of joining opposite side edges of the plastic film for formation of a back seam 12. However, it is within the purview of the present invention that the slider can be applied to the respective fastener assembly before the side edges of the film are joined to each other, but after the film has been formed by the forming collar to a generally tubular configuration.

While not illustrated in FIG. 6, an opening 24 is preferably formed in the plastic film material 50 prior to application of each fastener assembly 22 to the plastic film. The provision of opening 24 facilitates application of the slider 26 to each fastener assembly from a side of the plastic film material which is opposite that surface to which the fastener assembly is applied (which becomes the inside surface of the tube being formed). As noted, the provision of opening 24 further facilitates manipulation of the slider for opening and closing the fastener assembly. Formation of a frangible region in the form of a line of weakness 42 is also preferably effected prior to application of the fastener assemblies 22, and may be performed in conjunction with formation of openings 24 in the plastic film material 50.

After the plastic film material 50 is guided over the forming collar 62 to form a tube, opposite side edges of the plastic film are joined to each other for formation of back seam 12, such as by heat seal bar 66. Each slider 26 is applied to a respective fastener assembly by a suitable application mechanism 68, which includes a reciprocable component for advancing each slider 26 onto its respective fastener assembly, without separation of the profile strips of the fastener assembly.

Transverse seals are formed in the tube of material attendant to filling of the contents of the packages being formed, with one or more sets of seal bars 70 being employed for this purpose. Seal bars 70 form the end, top, and bottom seals 18 and 20 in each package 10 with a suitable cutting mechanism provided for cutting each package, after it has been formed, filled, and sealed, from its end-to-end relationship with like packages.

From the foregoing, numerous modifications and variations can be effected without departing from the true spirit and scope of the novel concept of the present invention. It is to be understood that no limitation with respect to the specific embodiment disclosed herein is intended or should be inferred. The disclosure is intended to cover, by the appended claims, all such modifications as fall within the scope of the disclosure.

What is claimed is:

1. A method of making reclosable packages each having a slider zipper assembly, comprising the steps of:

advancing a web of plastic film packaging material in a direction along a longitudinal axis thereof;

forming openings in said plastic film packaging material;

applying a plurality of profile strip fastener assemblies to said plastic film material transversely of said longitudinal axis, said profile strip fastener assemblies being positioned in respective alignment with said openings along said longitudinal axis;

each of said fastener assemblies comprising a pair of interlocking profile strips, said fastener assemblies being spaced apart by a distance corresponding to the length of each of said reclosable packages being formed;

applying a slider to each of said fastener assemblies through a respective one of said openings so that movement of each said slider along the length of the respective one of said fastener assemblies moves said pair of profile strips thereof into and out of interlocking engagement; and joining opposite side edges of said plastic film material to form a tube, and forming seals transversely of said tube to form a top seal and a bottom seal for each of said packages, wherein said fastener assemblies are applied to a surface of said plastic film material which becomes an inside surface of said tube, each said slider being applied to a portion of the respective fastener assembly which is exposed through the respective one of said openings from a side of said plastic film material opposite said surface through the respective opening defined by said plastic film material.

2. A method of making recloseable packages in accordance with claim 1, wherein:

said step of applying said slider is performed after said step of joining opposite side edges of said plastic film material.

3. A method of making recloseable packages in accordance with claim 1, including:

guiding said plastic film material over a forming collar to shape the material to a generally tubular configuration prior to said step of joining opposite side edges of said material, said step of applying said slider being performed after said step of guiding said plastic film material over said forming collar.

4. A method of making recloseable packages in accordance with claim 1, including:

forming a frangible tamper-evident region in said plastic film material for respective alignment with each said fastener assembly so that initial opening movement of said slider fractures the frangible region.

5. A method of making recloseable packages in accordance with claim 1, wherein:

each said slider has a pair of tapered walls for respective interlocking, sliding connection with said pair of profile strips of each said fastener assembly.

6. A method of making recloseable e packages in accordance with claim 5, wherein:

each said slider is applied to the respective fastener assembly without separation of the profile strips thereof.

7. A method of making recloseable e packages in accordance with claim 1, wherein:

each of said profile strips of each of said fastener assemblies includes a body portion, and a flange portion having a width greater than the respective body portion, each of said fastener assemblies being applied to said plastic film material by joining said flange portion of each said profile strip to said plastic film material.

* * * * *